US005673661A

United States Patent [19]

Jesel

[11] Patent Number: 5,673,661

[45] Date of Patent: Oct. 7, 1997

[54] VALVE LIFTER

[76] Inventor: Daniel Henry Jesel, 108 Pitney Ave., Spring Lake, N.J. 07763

[21] Appl. No.: 563,099

[22] Filed: Nov. 27, 1995

[51] Int. Cl.[6] ..... F01L 1/14

[52] U.S. Cl. ..... 123/90.48; 123/90.5; 123/90.61; 74/569

[58] Field of Search ..... 123/90.48, 90.49, 123/90.5, 90.61; 74/569

[56] References Cited

U.S. PATENT DOCUMENTS

| | | | |
|---|---|---|---|
| 1,000,722 | 8/1911 | Danver | 384/13 |
| 1,254,227 | 1/1918 | Huber | 384/13 |
| 1,345,942 | 7/1920 | McCain | 29/888.43 |
| 1,479,735 | 1/1924 | Page | 123/90.48 |
| 1,565,223 | 12/1925 | Church | 123/90.5 |
| 2,175,466 | 10/1939 | Johnson | 123/90.5 |
| 2,386,317 | 10/1945 | Jenny | 123/90.35 |
| 2,925,808 | 2/1960 | Baumann | 123/90.48 |
| 3,111,118 | 11/1963 | Weiman | 123/90.61 |
| 3,301,241 | 1/1967 | Iskenderian | 123/90.5 |
| 3,470,983 | 10/1969 | Briggs | 184/6.9 |
| 4,007,716 | 2/1977 | Jones | 123/90.48 |
| 4,231,267 | 11/1980 | Van Slooten | 74/569 |
| 4,326,484 | 4/1982 | Amrhein | 123/90.5 |
| 4,549,509 | 10/1985 | Burtchell | 123/90.16 |
| 4,607,599 | 8/1986 | Buente | 123/90.5 |
| 4,747,376 | 5/1988 | Speil | 123/90.55 |
| 4,771,741 | 9/1988 | Leer | 123/90.5 |
| 4,876,994 | 10/1989 | Speil | 123/90.5 |
| 4,885,952 | 12/1989 | Connell | 123/90.48 |
| 5,263,386 | 11/1993 | Campbell | 74/569 |
| 5,273,005 | 12/1993 | Philo | 123/90.5 |
| 5,307,769 | 5/1994 | Meagher | 123/90.5 |
| 5,347,965 | 9/1994 | Decuir | 123/90.61 |
| 5,394,843 | 3/1995 | Decuir | 123/90.39 |

*Primary Examiner*—Weilun Lo

*Attorney, Agent, or Firm*—Pillsbury Madison & Sutro L.L.P.

[57] ABSTRACT

To increase available space for intake ports in an internal combustion pushrod type overhead valve engine, pushrod and pushrod bores running adjacent the ports are repositioned away from the ports. New valve lifters are provided with pushrod seats which are offset in the desired direction. Further offset is also provided by boring new valve lifter bores for the new valve lifters, which valve lifter bores have longitudinal axes that are also offset in the desired direction. Rocker arms are also provided with pushrod seats being offset in the same direction and by the same magnitude as the offset pushrod seats and the valve lifters. This offsetting of the pushrods away from the adjacent ports allows additional space for increasing the size and cross-sectional area of the ports to increase the breathing and power of the engine.

2 Claims, 8 Drawing Sheets

VALVE LIFTER

BACKGROUND OF THE INVENTION

1. Field of the Invention

The present invention relates to high performance racing engines and more particularly, to an improved valve lifter for such racing engines.

2. Description of the Related Art

In a high performance racing engine, the maximum power that can be developed by the engine is limited by the flow rate of intake charge into the cylinder and flow rate of exhaust from the cylinder. This flow rate can be affected by a number of factors, including the size of the intake and exhaust ports, respectively. In a standard automotive four-stroke engine using pushrod and rocker arm actuated overhead valves, the size of the intake ports is limited by the placement of the pushrods. Since the pushrods usually border the intake ports, the width and cross-sectional area of the ports is constrained by this placement of the pushrods. Thus, in a conventional high performance racing engine, maximum power can be constrained by intake ports which are too small because of the positioning of the pushrods so closely adjacent to the ports.

It is desired to provide an improved valve lifter and method of utilizing the valve lifter which will allow for off-setting of the pushrods away from the port walls, so that additional space is available for increasing the width and area of the ports.

SUMMARY OF THE INVENTION

The present invention is an improved valve lifter and method of utilizing the valve lifter for increasing the available space for intake ports in an internal combustion engine by offsetting the pushrods away from the intake ports. To accomplish this, the pushrod seat in the valve lifter is not in the center of the valve lifter as with conventional valve lifters, but is offset in a direction away from the intake port which most closely borders that pushrod's gallery.

The pushrod can also be offset away from the closest bordering intake port by offsetting the lifter bore axis in a direction away from the intake port. This is accomplished by boring a new larger lifter bore axis in the engine block with the axis of this new bore being offset in the desired direction from the original lifter bore axis. Preferably, the new offset lifter bore is large enough to completely encompass the original lifter bore to provide full support for the valve lifter while not requiring the filling in of the remaining original lifter bore. This new offset lifter bore can be bushed if desired to decrease the diameter of the new valve lifter as well as to provide additional stability to the valve lifter. Preferably, the valve lifter will be a roller type lifter to reduce rotational forces imparted on the lifter by the camshaft. Further, in utilizing the improved valve lifter with the offset valve lifter bore as described above, the roller for the valve lifter is offset toward the direction of the port so as to properly align with the existing cam lobe. Alternatively, a new camshaft can be provided with camshaft lobes which are also offset in a direction away from the respective intake port so as to minimize or eliminate offsetting of the valve lifter roller with respect to the valve lifter axis. The offset lifter can be used in conjunction with an offset pushrod seat in the valve lifter to increase the total offset of the pushrod.

With the foregoing in mind, other objects, features and advantages of the present invention will become more apparent upon consideration of the following description and the appended claims with reference to the accompanying drawings, all of which form part of this specification, wherein like reference numerals designate corresponding parts in various figures.

BRIEF DESCRIPTION OF THE DRAWINGS

FIG. 6(*b*) is a partial sectional view of the valve lifter of the present invention at partial lift;

FIG. 6(*c*) is a partial sectional view of the valve lifter of the present invention at full lift;

DETAILED DESCRIPTION OF THE PRESENTLY PREFERRED EMBODIMENTS

Figure 1:
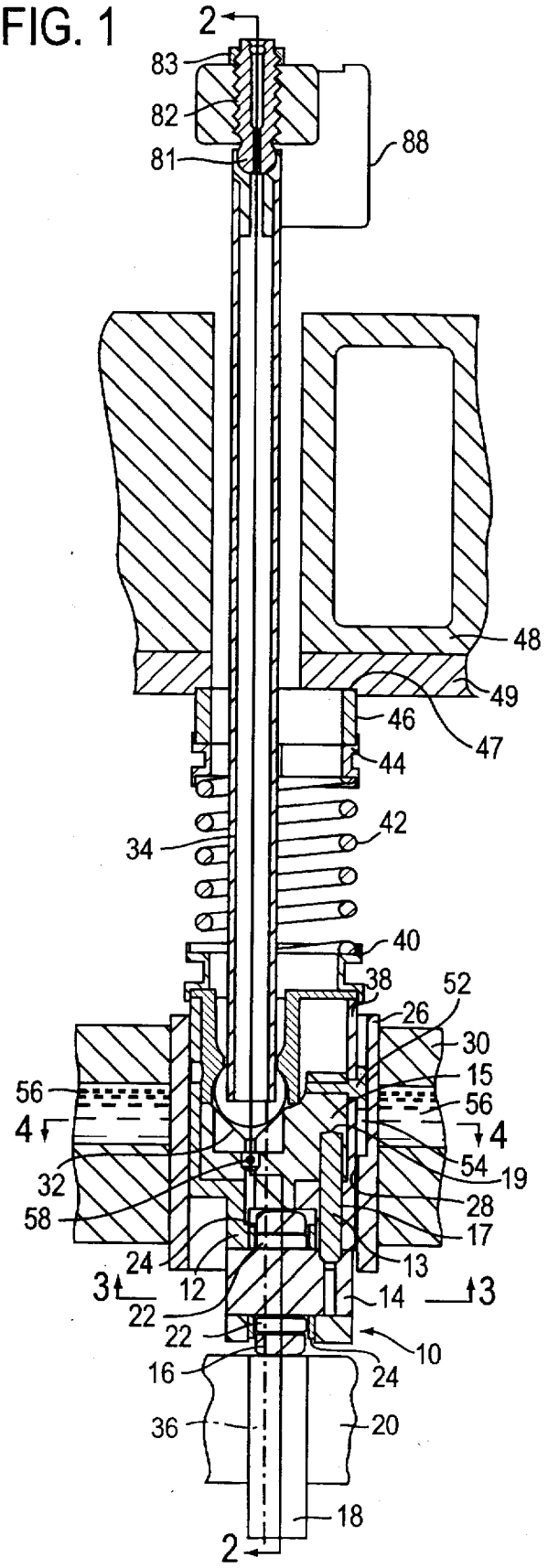
FIG. 1 is a partial sectional view taken along section line 1—1 in FIG. 2 of the valve lifter of the present invention installed in an engine.
Figure 2:
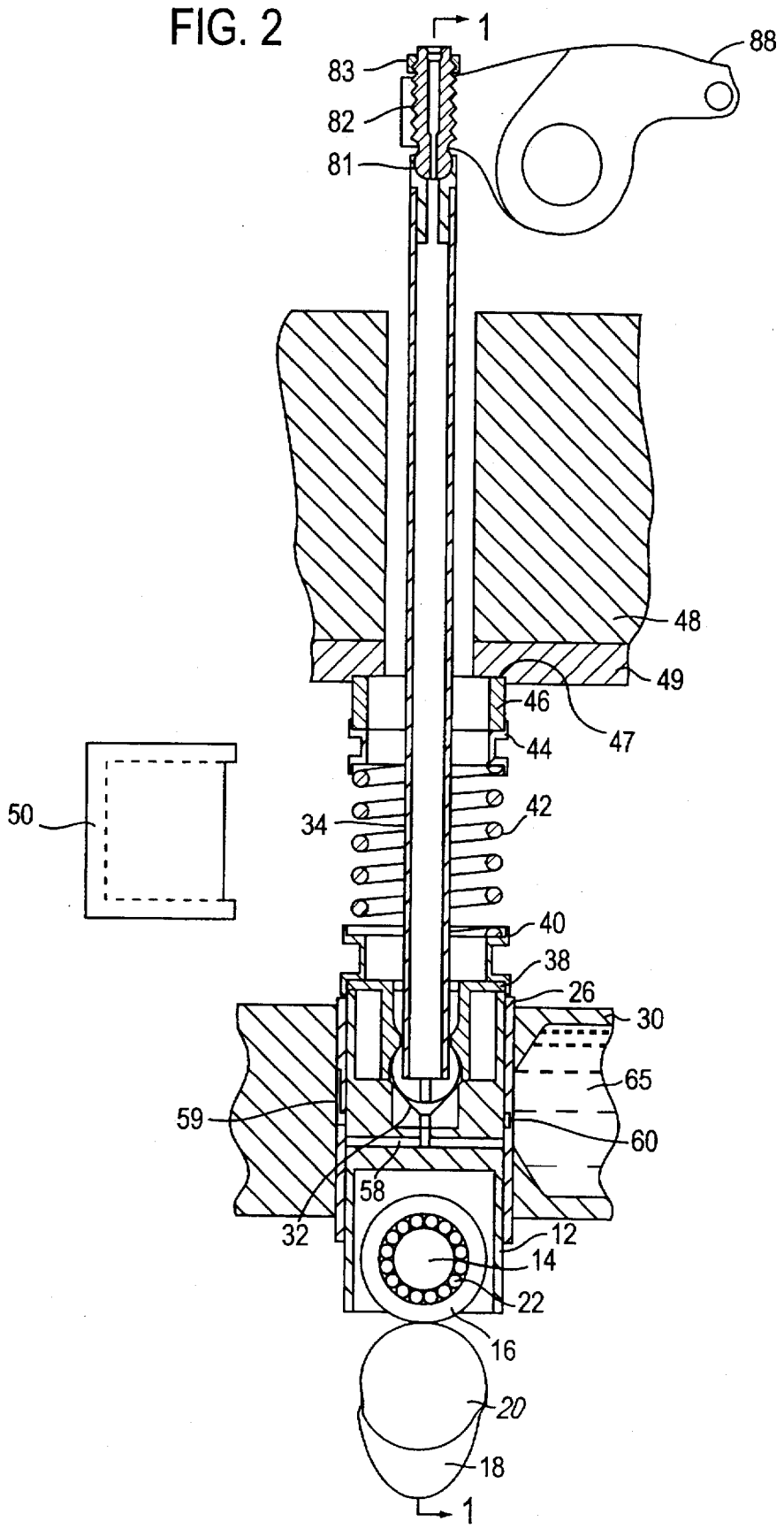
FIG. 2 is a partial sectional view taken along section line 2—2 in FIG. 1 of the valve lifter of the present invention.
Figure 3:
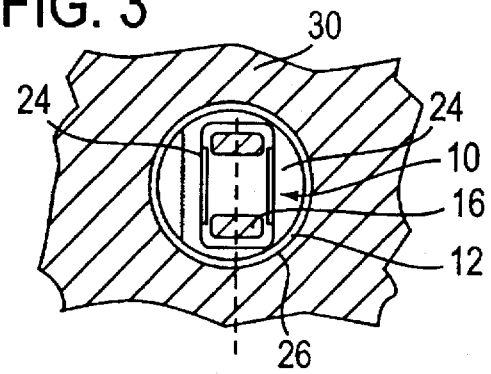
FIG. 3 is a partial sectional view taken along section line 3—3 in FIG. 1 of the valve lifter of the present invention.
Figure 4:
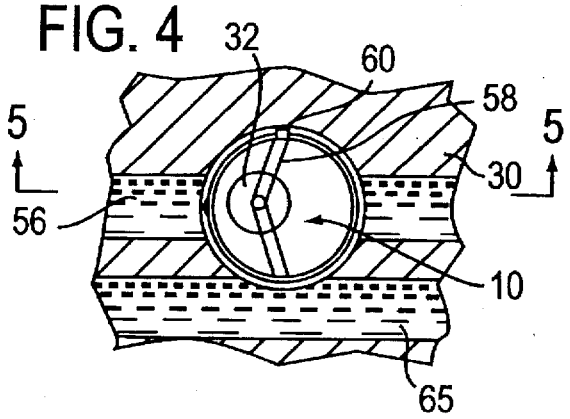
FIG. 4 is a partial sectional view taken along section line 4—4 in FIG. 1 of the valve lifter of the present invention.

An improved valve lifter 10 according to the present invention can be seen in FIGS. 1–4. The valve lifter 10 includes a lifter body 12 which supports roller pin 14. A roller 16 for engagement with lobe 18 of camshaft 20 is rotatably supported on roller pin 14 by needle bearings 22. Roller pin 14 is larger than conventional roller pins to increase load capacity and decrease failure due to overload of the roller 16, roller pin 14 and needle bearings 22. The section thickness of the roller 16 is also increased, as compared to a conventional roller, to further increase the load capacity of the roller 16. This results in a larger diameter roller than conventionally used, which quickens the action of the cam on the valve lifter utilizing the same cam lobe profile. A slower lift profile cam lobe can thus be used with the larger diameter roller to provide a similar lift curve as before, while the slower lift profile cam increases cam, roller and roller pin life. Hardened and polished thrust washers 24 prevent roller 16 to body 12 contact and keep the thrust surfaces of the valve lifter 10 from brinelling by the roller 16 and needle bearings 22.

Roller pin 14 is retained in the lifter body 12 and prevented from rotating by a retaining pin 13 which engages between roller pin 14 and a bore 19 in piston 15 through bore 17 in lifter body 12. Piston 15 is pressed into lifter body 12 and into engagement with retaining pin 13 which also prevents piston 15 from rotating in lifter body 12. Retaining pin 13 has splines on its upper length to firmly engage piston 15 and to prevent floating of pin 13. Floating of pin 13 can also be prevented by eliminating unnecessary clearance between the bottom of bore 19 and the upper tip of retaining pin 13. Index pin 52 is pressed into piston 15 through lifter body 12 to lock the entire valve lifter 10 together.

In the preferred embodiment, a bushing 26 having valve lifter bore 28 for supporting valve lifter 10 is pressed into engine block 30. An alignment bar (not shown) is used when pressing each bushing 26 into the block 30 to ensure correct orientation and height of the installed bushing 26. Valve lifter 10 further includes pushrod seat 32 for engagement with pushrod 34. As can best be seen in FIG. 1, pushrod seat 32 is shifted away from lifter axis 36. Likewise, roller 16 can be shifted in the opposite direction away from lifter axis 36 to provide a maximum transverse offset between roller 16 and pushrod seat 32. Pushrod seat 32 is positioned low in valve lifter 10 to decrease the structure and mass necessary to support a higher positioned pushrod, as compared to conventional valve lifters. This allows the mass and weight of the valve lifter to be reduced, while increasing the stability of the valve lifter/pushrod by decreasing the distance between the pushrod seat 32 and the roller 16 to cam lobe 18 contact area, thereby decreasing the rocking forces imparted on the valve lifter 10 by the cam 20 and pushrod 34.

Pushrod 34 is maintained in pushrod seat 32 by spring perch 38. Spring collar 40 engages spring perch 38 and supports helper spring 42. An opposite end of spring 42 engages spring collar 44 which engages spring spacer 46 which engages a seat 47 in cylinder head 48 or head plate 49 (if a head plate is used). The function of spring 42 will be described in more detail below. Pushrod 34 engages a rocker arm in any known manner including the use of a threaded tip 81 which engages a threaded attachment 82 and locknut 83.

Index pin 52 engages slot 54 in bushing 26 to prevent rotation of valve lifter 10. Index pin 52 is also prevented from moving out of valve lifter 10 by bushing 26.

Figure 5:
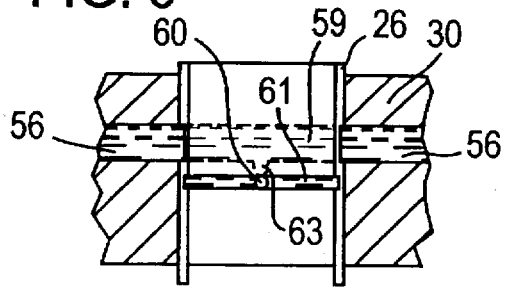
FIG. 5 is a partial sectional view taken along section line 5—5 in FIG. 4 of a valve lifter bushing of the present invention installed in an engine.
Figure 16:
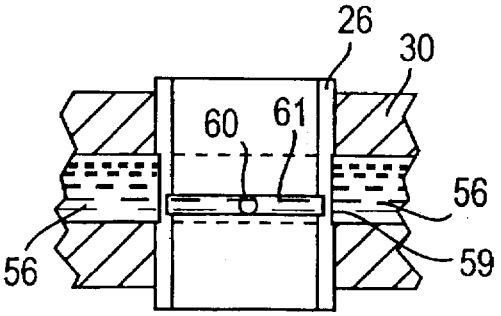
FIG. 16 shows an alternative embodiment of a bushing of the present invention.

Oil is supplied to valve lifter 10 through oil galley 56 in engine block 30. Valve lifter 10 includes oil passage 58 through which oil from oil galley 56 can flow to pushrod seat 32, through pushrod 34 and to the remainder of the valve train, as is conventionally known. Bushing 26 includes annular oil channel 59 communicating via oil channel 63 with oil port 60. Oil port 60 communicates with internal oil supply groove 61 which preferably runs completely around the interior of bushing 26. Oil channel 59 runs around the exterior of bushing 26 from one side of oil galley 56 (the right side as seen in FIG. 1) to the other side of oil galley 56 (the left side as seen in FIG. 1). Preferably, oil channel 59 is positioned only on the side of bushing 56 which is closest to the interior of the V in a conventional V-8 engine. Since there is usually a water passage 65 bordering valve lifter bore 28 on the exterior of the V, positioning the oil channel 59 only on the interior side of bushing 56 prevents contamination of the oil by cooling fluid should there be a breakthrough between the water passage and the valve lifter bore 28, especially when increasing the size of bore 28. Thus, one side of galley 56 is in constant communication with the other side of galley 56 and oil is able to continuously pass by lifter 10 for flow to subsequent lifters. Positioning of the oil port 60 and oil supply groove 61 lower than the oil galley 56 (as seen in FIG. 5) also allows the pushrod seat 32 to be lowered into the valve lifter 10 by assuring a valve lifter oil supply which is positioned lower than the pushrod seat 32. The height of oil channel 59 can be altered depending on the height of oil galley 56 and may also be used to restrict the flow of oil from one side to the other side of oil galley 56. FIG. 16 shows an alternative embodiment of the oil channel 59 which generally has a height corresponding to the height of oil galley 56. Oil channel 59 can also be disposed on the interior surface of the bushing and communicate with the oil galley 56 through oil transfer ports in the bushing or a portion of the oil channel 59 may be on the interior of the bushing and communicate with one side of oil galley 56 through an oil transfer port in the bushing while a portion of oil channel 59 is disposed on the exterior of the bushing and communicates with the interiorly disposed portion of the oil channel through another oil transfer port in the bushing.

Figure 6C:
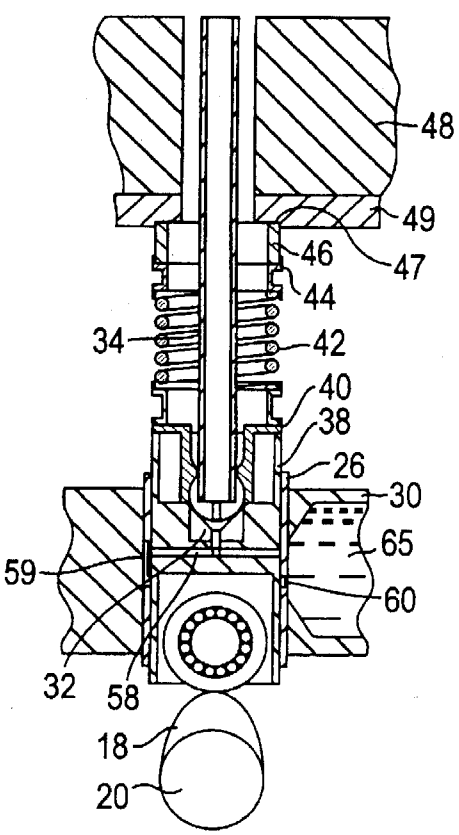
FIG. 6(*a*) is a partial sectional view of the valve lifter of the present invention at no lift.
Figure 6B:
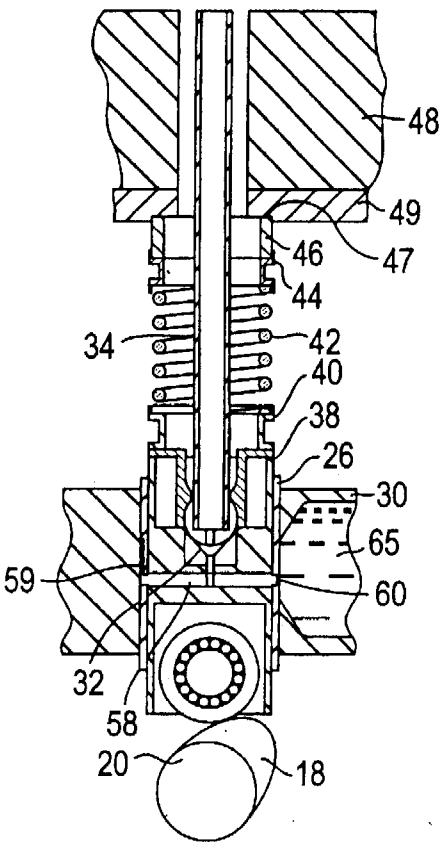
Figure 6A:
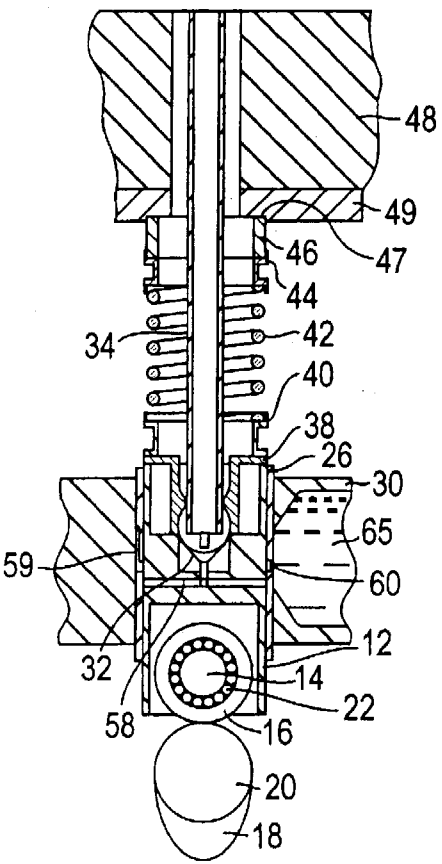

However, unlike conventional valve lifters, oil passage 58 is not in constant communication with oil galley 56. Rather, oil from oil galley 56 can only be supplied to oil passage 58 through oil channel 59, oil channel 63, port 60 and supply groove 61, which is only in communication with oil passage 58 at certain portions of the stroke of valve lifter 10. This can best be seen in FIGS. 6(*a*)–6(*c*). As seen in FIG. 6(*a*), when valve lifter 10 is at no lift, oil passage 58 is below oil port 60 and oil supply groove 61. Therefore, oil from oil galley 56 cannot be supplied to oil passage 58 through oil port 60 and oil supply groove 61. However, as can be seen in FIG. 6(*b*), at approximately half lift, oil passage 58 is in alignment with oil supply groove 61, whereupon oil from oil galley 56 is fed to oil passage 58. As valve lifter 10 continues to maximum lift, communication between oil passage 58 and oil supply groove 61 is again disrupted, so that oil can no longer flow from oil galley 56 to oil passage 58. Thus, oil passage 58 is in communication with oil galley 56 through oil channel 59 and oil supply groove 61 twice per full revolution of camshaft 20. In this manner, there is not a constant feed of oil from oil galley 56 to each valve lifter and the resultant constant loss of oil pressure at each valve lifter. Rather, oil is supplied to each valve lifter with a resultant loss in oil pressure during only a portion of the lifter cycle. This preserves oil pressure in the valve system as compared to a conventional system where there is continuous oil pressure loss at each valve lifter.

Figure 7:
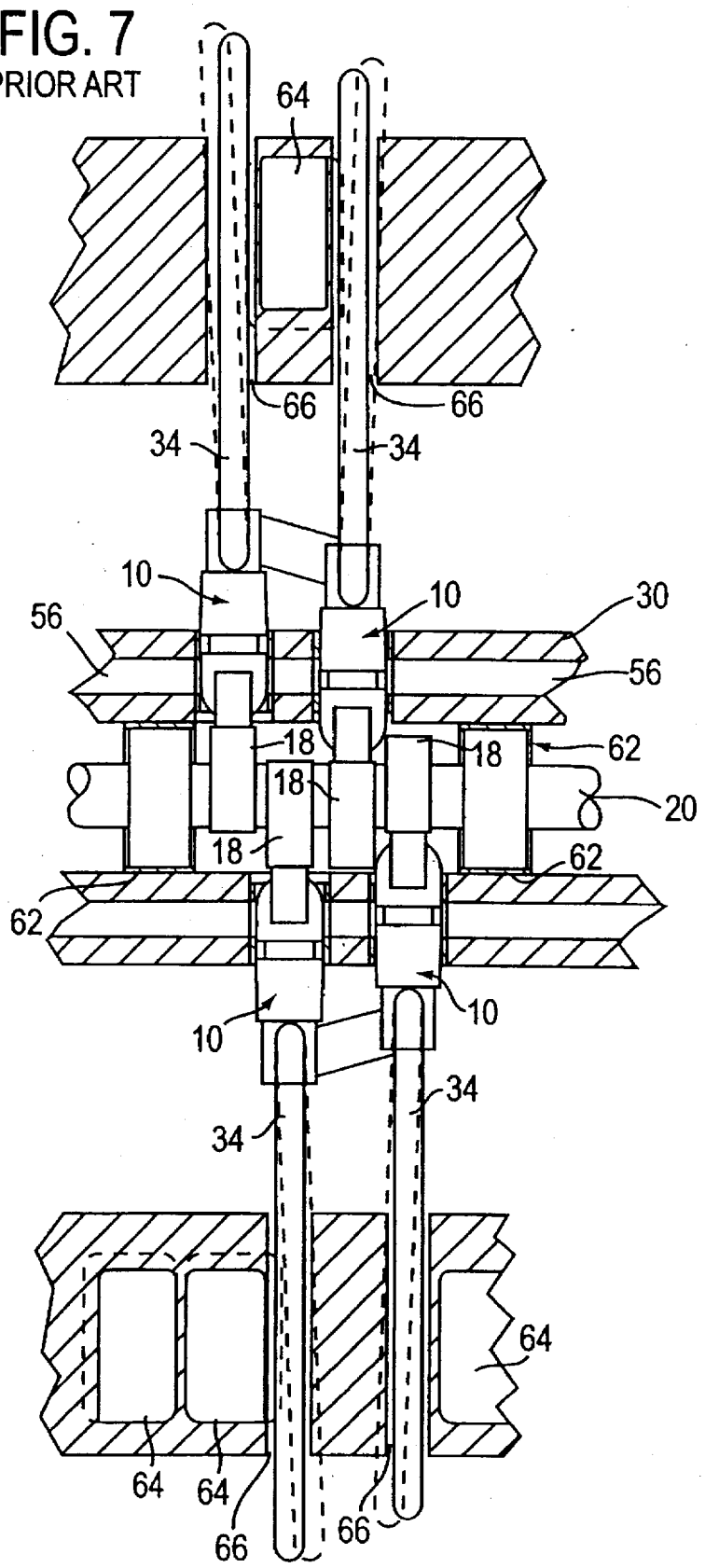
FIG. 7 PRIOR ART
FIG. 7 (PRIOR ART) is a partial sectional view of an engine with conventional valve lifters installed.

FIG. 7 (prior art) shows a partial sectional view of a conventional engine. Camshaft 20 is supported in engine block 30 by camshaft bearings 62. Valve lifters 10 engaged their respective camshaft lobes 18. Pushrods 34 engage between valve lifters 10 on one end and rocker arms (not shown) on the other end. Intake ports 64 are positioned between or adjacent pushrods 34 and pushrod bores 66. Therefore, the width and cross-sectional area of each port 64 is limited by the positioning of pushrods 34. Each port 64 must contain a minimum wall thickness so as to prevent cracking of the wall with the resultant leaking into or out of the intake port. A portion of an outer wall of the port 64 is bordered by the bores 66 within which are positioned the respective pushrods 34 bordering the intake port 64. Thus, the width and cross-sectional area of the port 64 can only be increased to a point where the minimum port wall thickness between the interior of the port 64 and the pushrod bore 66 is reached. Any further increase in the size of the port 64 will allow leakage into and out of the ports through the pushrod bores 66. As can be seen in FIG. 7, when the ports 64 are increased to a size as shown in phantom, the port 64 will break through to pushrod bores 66 with a resultant leak between the ports 64 and the respective bores 66.

Figure 13:
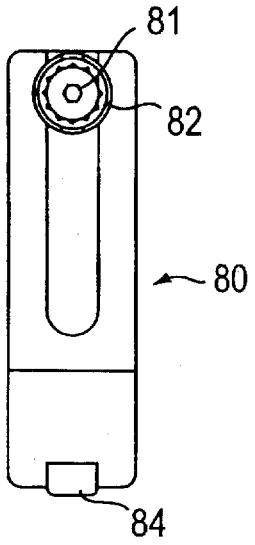
FIG. 13 PRIOR ART
FIG. 13 (Prior Art) is a top view of a rocker arm having no offset.
Figure 14:
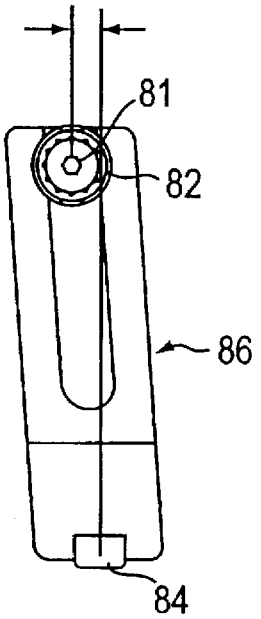
FIG. 14 PRIOR ART
FIG. 14 (Prior Art) is a top view of an angled offset rocker arm.
Figure 15:
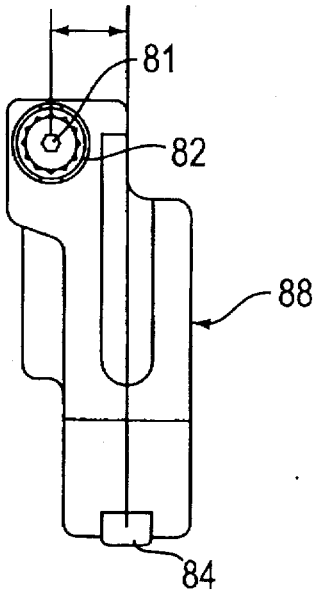
FIG. 15 PRIOR ART
FIG. 15 (Prior Art) is a top view of a dogleg offset rocker arm.

One previously known method for increasing the room available for increasing the size of the port 64 is to angle the pushrods 34 away from ports 66, as shown in phantom in FIG. 7. This also requires offsetting the pushrod seat in the rocker arm (not shown) in the desired direction. See FIG. 13 (Prior Art) which shows a top view of a conventional roller rocker arm 80 having no offset between a pushrod tip 81 and valve actuating roller 84. FIG. 14 (Prior Art) shows an angled rocker arm 86 offsetting pushrod tip 81 from valve actuating roller 84. FIG. 15 (Prior Art) shows a dogleg rocker arm 88 offsetting even further the pushrod tip 81 from valve actuating roller 84.

However, the angled pushrod offsetting method is not desirable, as angling of the pushrods will create undesirable lateral and bending forces on the valve lifters, pushrods and rocker arms, resulting in increased wear and decreased tolerance for high rpm and its associated forces than if the pushrods were maintained at an angle substantially perpendicular to the camshaft 20.

Figure 8:
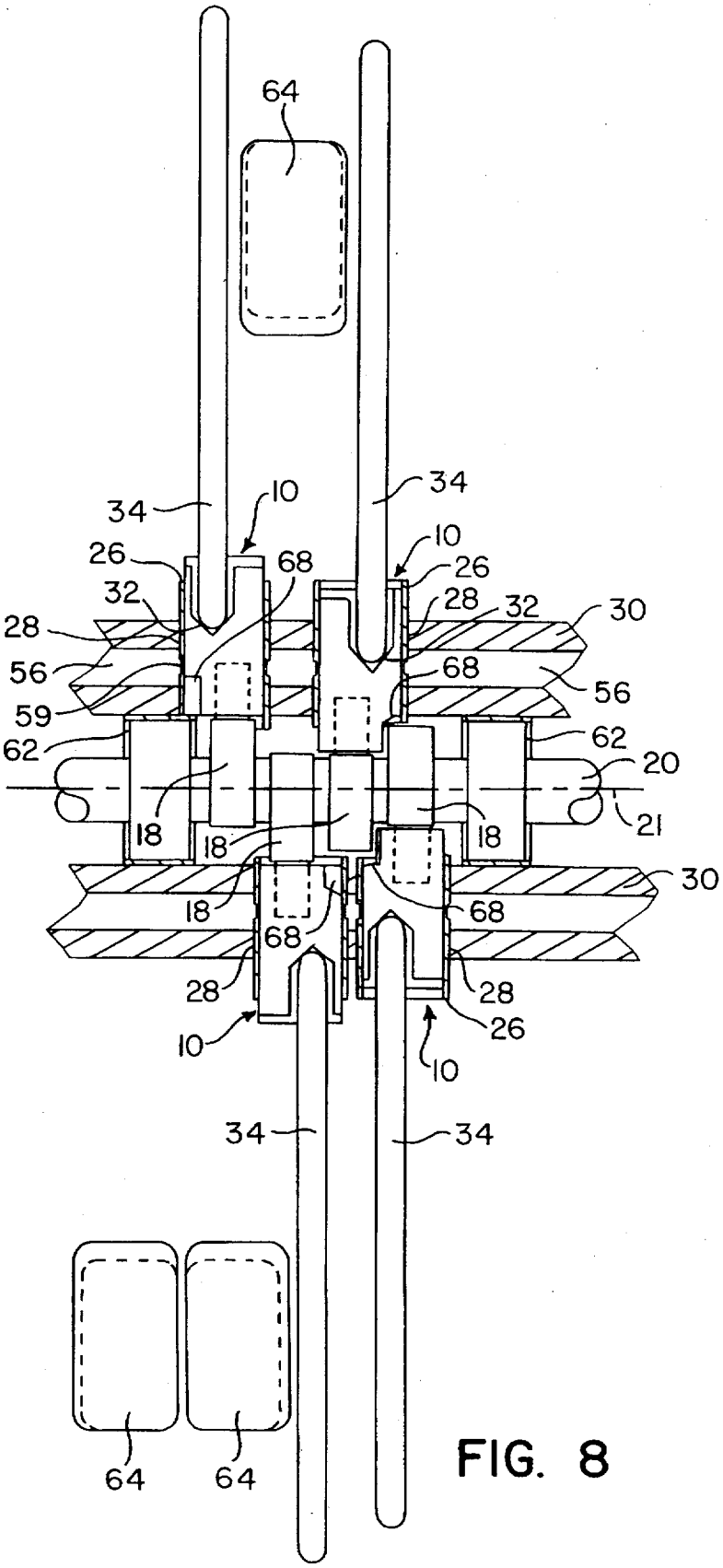
FIG. 8 is a partial sectional view of an engine with valve lifters of the present invention installed.

FIG. 8 shows a partial sectional view of one embodiment of the present invention. New valve lifter bores 28 have been bored in engine block 30. These new bores 28 are larger than the original bores and have been bored so the longitudinal axis of each bore is offset from the longitudinal axis of the original bore. The offset of each of the new bores is in a direction generally parallel to the camshaft and away from the respective intake port bordered by each respective pushrod 34 engaging each valve lifter 10. This allows each pushrod to be moved away from the respective intake port 64, thereby allowing for larger intake ports 64. The larger ports 64 shown in FIG. 8 can be compared with the original ports 64 (shown in phantom in FIG. 8) and it can be seen that the cross-sectional area of each of the new ports 64 has been increased. Further, the present invention allows increased flexibility in maintaining a desired port height to port width ratio while increasing the cross-sectional area of the port.

As can also be seen in FIG. 8, each valve lifter 10 is supported in bushing 26 installed in each respective valve lifter bore 28. Each valve lifter bushing 26 is longer than each of the respective valve lifter bores 28 and protrudes above and below each valve lifter bore 28. This additional bushing height provides increased support for the valve lifters 10, especially when the valve lifters are at maximum lift. The bushings are extended above and below the valve lifter bores 28 to the extent there is the necessary clearance between the bushings and moving components. Further, each valve lifter 10 is provided with a lower edge cut-away 68 to provide adequate clearance between the valve lifter and adjacent cam bearings 62 or adjacent lobes 18.

The present invention can be used with new cylinder heads and head plates which are specifically designed to take advantage of the new pushrod positioning. They do this by providing relocated pushrod bores which provide additional area for larger intake ports 64. Alternatively, existing cylinder heads and head plates can also be used with the present invention. However, these existing cylinder heads and head plates need to be modified to provide the additional area necessary for the larger ports 64. This is accomplished by welding or otherwise filling in the existing pushrod bores in the cylinder heads and head plates, followed by re-boring new pushrod bores in the cylinder heads and head plates which are positioned outward from the intake ports 64. Then, the ports themselves can be enlarged to the desired cross-sectional area and height to width ratio now allowed by the new pushrod and pushrod bore positioning.

Figure 9:
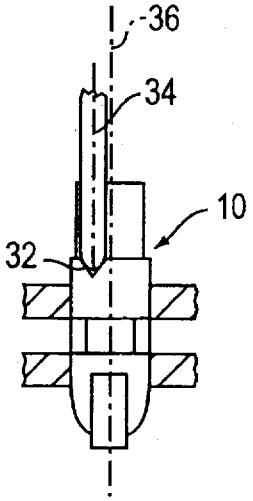
FIG. 9 is a partial sectional view of an alternative embodiment valve lifter of the present invention installed in an engine.
Figure 10:
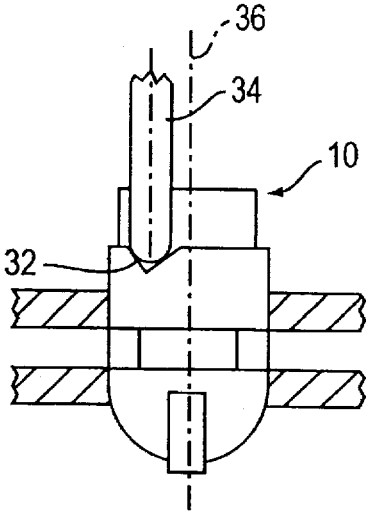
FIG. 10 is a partial sectional view of an alternative embodiment valve lifter of the present invention installed in an engine.

It should be understood that the different aspects of the present invention can be used separately or in conjunction with one another, depending upon the desired offset of the pushrods and the desired extent of the modifications to the existing engine. For instance, as shown in FIG. 9, the present invention can be practiced with an otherwise conventional valve lifter, by merely offsetting the pushrod seat in the valve lifter. However, the allowable offset will not be large due to the physical constraints of the existing lifter. As seen in FIG. 10, the offset can be increased with a conventional type lifter by boring a new valve lifter bore 28 generally concentric with the original valve lifter bore 28 but larger than the original valve lifter bore 28. This allows the use of a larger conventional type valve lifter 10, thereby providing additional room for offsetting the pushrod seat 32 and pushrod 34. In this embodiment, roller 16 still lies on the longitudinal axis of valve lifter 10.

Figure 11:
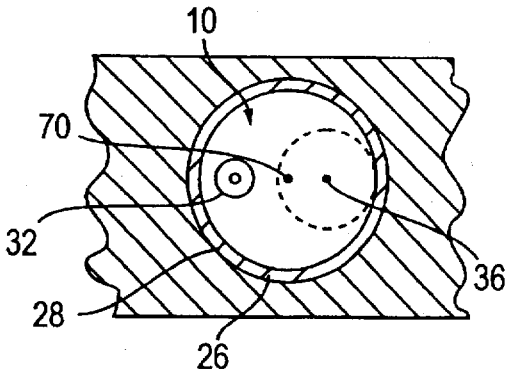
FIG. 11 is a partial sectional view of a valve lifter and bushing of the present invention installed in an engine.

The largest pushrod offset is provided by the embodiment shown in FIG. 8, whereby the new valve lifter bore 28 is not bored concentric with the original bore 28 but is bored offset from the original valve lifter bore 28 so that longitudinal axis 70 of new valve lifter 10 will also be offset from the longitudinal axis 36 of the original valve lifter 10. See FIG. 11, where the original valve lifter bore 28 is shown in phantom with the original valve lifter longitudinal axis 36. New valve lifter bore 28 is larger than the original valve lifter bore 28 and is offset in the desired direction so that the longitudinal axis 70 of the new valve lifter bore is also offset in the desired direction.

In this embodiment, pushrod seat 32 is further offset in the desired direction to increase the total offset between the new pushrod/pushrod bore positioning and the original pushrod/pushrod bore positioning. However, unless a new camshaft 20 is provided with repositioned cam lobes 18, it will be necessary to retain substantially the original positioning of roller 16 to utilize the original camshaft 20. This is accomplished by positioning the new roller 16 in the new valve lifter 10 to the other side of longitudinal axis 70 than the side to which new pushrod seat 32 has been shifted. Thus, as compared to the original valve lifter/pushrod setup wherein the roller 16, valve lifter 10, and pushrod 34 all generally share the same axis 36, in this embodiment of the present invention, only roller 16 still remains on axis 36. The new valve lifter bore axis 70 and pushrod seat 32 are both shifted in the desired direction of the pushrod offset.

If desired, the offset in the pushrod seat 32 need not only be along a line generally parallel to the longitudinal axis of the camshaft 20 but can also be provided with a component of offset in a direction generally perpendicular to a plane defined in part by the longitudinal axis of the camshaft 20. In this embodiment, the corresponding pushrod seat in the rocker arm would also be provided with the same component of perpendicular offset.

Bushing 26 may be used in this embodiment to provide additional stability to valve lifter 10. However, if desired, the bushing 26 can be omitted with the valve lifter 10 positioned directly in valve lifter bore 28. The new larger valve lifter bore 28 can completely subsume the original valve lifter bore 28, but need not do so if strength, space or other requirements indicate otherwise.

Figure 12:
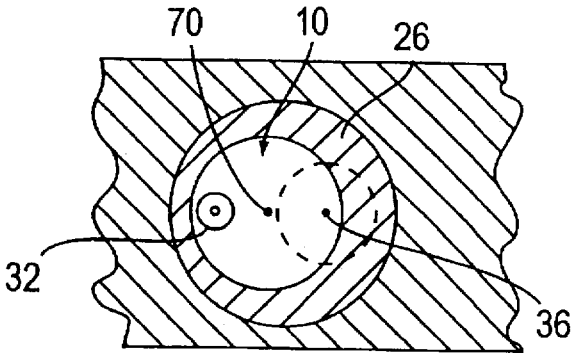
FIG. 12 is a partial sectional view of an alternative embodiment valve lifter and bushing of the present invention installed in an engine.

One advantage of utilizing a larger diameter valve lifter 10 with bushing 26 and/or valve lifter bore 28 is the increased load surface, which decreases local loading forces. However, where circumstances dictate a smaller diameter valve lifter, offset of the smaller diameter valve lifter 10 can still be maximized by utilizing a bushing 26 installed in valve lifter bore 28, wherein bushing 26 also includes an offset internal bore for receiving the valve lifter 10. See FIG. 12.

In a high performance racing engine, it has been found desirable to provide an auxiliary spring force (in addition to the spring force of the valve spring) to the valve lifter 10 to better control the movement of the valve lifter while the engine is operating at high rpm. In conventional systems, a helper spring is placed between the cylinder head and an attachment on the pushrod itself. However, this is undesirable because it requires the cylinder head to be removed to change or replace the spring, pushrod or valve lifter. Another disadvantage is that the spring applies its force through the pushrod to the pushrod seat of the valve lifter. The contact area between the pushrod and pushrod seat is relatively small and it is not desirable to concentrate the additional spring force of the helper spring on this small contact area. Further, a conventional system needs a special pushrod designed to engage the helper spring. Friction from the helper spring also prevents the pushrod from pivoting freely and when the pushrod is not parallel to the axis along which the valve lifter reciprocates, the helper spring exerts a side load on both the rocker arm attachment/adjuster and the valve lifter in the lifter bore.

The present invention overcomes these disadvantages of the conventional system. Helper spring 42, spring collar 40 and spring collar 44 are compressed together and inserted into spring clamp 50. With the valve lifter 10 at zero lift, the compressed spring collar/helper spring assembly is placed on top of valve lifter 10. Spring spacer 46 is then placed between the top spring collar 44 and the head plate 49. Pushrod 34 is then inserted through the head 48, head plate 49, spring spacer 46, spring collar 44, helper spring 42 and spring collar 40. A clearance slot is provided in spring clamp 50 so that the pushrod 34 can pass through the compressed spring collar/helper spring assembly before the spring clamp 50 is removed. Likewise, a clearance slot is also provided in spring perch 38 so that spring perch 38 can now be placed between spring collar 40 and valve lifter 10 and over pushrod 34 while pushrod 34 engages pushrod seat 32. The camshaft 20 is then rotated to lift the valve lifter to compress the spring perch 38, spring collar 40, helper spring 42, spring collar 44 and spring spacer 46 between the valve lifter 10 and head plate 49. The dimensions of the spring clamp 50 are designed so that at full lift, the spring clamp 50 can be easily removed from the helper spring 42 and spring collars 40 and 44. At this point, the rocker arm may be installed.

The present helper spring system has several advantages. First, replacement of the pushrod 34, helper spring 42 and valve lifter 10 can be accomplished without removal of the cylinder head 48 or head plate 49. The helper spring 42 engages the valve lifter 10 and does not increase the spring load on the pushrod 34. Since the helper spring does not engage the pushrod 34, special pushrods are not needed and conventional pushrods may be used, including pushrods which are directly connectable to the rocker arm. Further, the pushrod is allowed to pivot freely and because the helper spring is maintained at a constant angle parallel to the axis of the valve lifter, additional side loading of the valve lifter and rocker arm adjuster are minimized. Additionally, pre-load and installation height of the helper spring can be adjusted by using spring spacers 46 of different heights.

While the present invention has been described in reference to increasing the size of intake ports, it should be understood that the present invention is also applicable to increasing the size of exhaust ports in applications where the exhaust ports are bordered by pushrod bores.

While the invention has been described in accordance with what is presently believed to be the most practical and preferred embodiment, it is to be understood that the invention is not to be limited to the disclosed embodiments but on the contrary, is intended to cover various modifications and equivalent arrangements included within the spirit and the scope of the appended claims, which claims are to be interpreted in the broadest manner so as to encompass all such equivalent structures.

What is claimed is:

1. A valve lifter for mechanically coupling a camshaft and a pushrod, comprising:

a body;

a roller rotatably connected to the body for engaging a cam lobe of the camshaft; and a pushrod seat on the body for engaging the pushrod, wherein the pushrod seat is offset from a longitudinal axis of the valve lifter in a direction generally parallel to a longitudinal axis of the camshaft.

2. A valve lifter as in claim 1, wherein a center line of a face of the roller which engages the cam lobe and which is perpendicular to an axis of rotation of the roller is offset from the longitudinal axis of the valve lifter in a direction generally parallel to the longitudinal axis of the camshaft and to an opposite side of the longitudinal axis of the valve lifter as compared to the offset of the pushrod seat.

* * * * *